US009752109B2

(12) United States Patent
Dürrschmidt et al.

(10) Patent No.: US 9,752,109 B2
(45) Date of Patent: Sep. 5, 2017

(54) LIQUID DETERGENT COMPOSITION

(71) Applicant: ECOLAB USA Inc., St. Paul, MN (US)

(72) Inventors: Thomas Dürrschmidt, Hilden (DE); Matthew Frank Zurbey, Cottage Grove, MN (US); Amila Bilic, Oberhausen (DE)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 14/897,493

(22) PCT Filed: Mar. 25, 2013

(86) PCT No.: PCT/EP2013/056323
§ 371 (c)(1),
(2) Date: Dec. 10, 2015

(87) PCT Pub. No.: WO2014/154244
PCT Pub. Date: Oct. 2, 2014

(65) Prior Publication Data

US 2016/0137957 A1 May 19, 2016

(51) Int. Cl.

| | |
|---|---|
| ***C11D 1/66*** | (2006.01) |
| ***C11D 1/72*** | (2006.01) |
| ***C11D 3/39*** | (2006.01) |
| ***B08B 3/04*** | (2006.01) |
| ***C11D 17/00*** | (2006.01) |
| ***C11D 3/37*** | (2006.01) |

(52) U.S. Cl.
CPC ..... *C11D 17/0017* (2013.01); *C11D 1/66* (2013.01); *C11D 3/3765* (2013.01); *C11D 3/3945* (2013.01); *C11D 3/3947* (2013.01)

(58) Field of Classification Search
CPC .. C11D 1/66; C11D 1/72; C11D 3/044; C11D 3/3746; C11D 3/39; C11D 17/0021; B08B 3/04
See application file for complete search history.

(56) References Cited

U.S. PATENT DOCUMENTS

| | | | | |
|---|---|---|---|---|
| 4,826,618 | A | 5/1989 | Borseth et al. | |
| 5,399,285 | A | 3/1995 | Kanluen | |
| 5,863,887 | A * | 1/1999 | Gillette | C11D 1/62 510/496 |
| 2013/0040870 | A1 | 2/2013 | Arisandy | |

OTHER PUBLICATIONS

PCT, "International Search Report" issued in connection to International Application No. PCT/EP2013/056323, mailed on Oct. 25, 2013, 9 pages.

* cited by examiner

*Primary Examiner* — Brian P Mruk
(74) *Attorney, Agent, or Firm* — McKee, Voorhees & Sease, PLC

(57) ABSTRACT

The invention refers to a liquid detergent concentrate composition comprising an emulsion having a water phase and an oil phase, the composition comprising based on the whole concentrate: (A) 1-50 wt.-% of a source of alkalinity; (B) 1-70 wt.-% of a at least one non-ionic surfactant; (C) 0.1-10 wt.-% of a copolymer of (1) at least one monomer of the formula (I): $H_2C{=}C(R^1){-}COOH$, wherein $R^1$ is a linear or branched $C_1$-$C_6$ alkyl or phenyl group; and (2) at least one monomer of (meth)acrylic acid ($C_1$-$C_6$) alkyl or phenyl ester; (D) 0.1-10 wt.-% of a copolymer of (i) acrylic and/or methacrylic acid; (ii) at least one monomer of the formula (III): $H_2C{=}C(R^3){-}C(O){-}O{-}(CH_2CH_2O)_n{-}R^4$, wherein $R^3$ is H or $CH_3$, n is at least 2 and preferably has an average value of at least 10, preferably 10 to 70, 10 to 60, 10 to 30, and R4 is a hydrophobic group containing 8 to 24 carbon atoms; and (iii) at least one monomer of $C_1$-$C_4$ alkyl (meth)acrylate.

22 Claims, No Drawings

LIQUID DETERGENT COMPOSITION

CROSS-REFERENCE TO RELATED APPLICATIONS

This is a U.S. National Phase application claiming priority to PCT/EP2013/056323 filed Mar. 25, 2013 of which is herein incorporated by reference in its entirety.

FIELD OF THE INVENTION

The invention relates to a liquid detergent concentrate composition, to a stable aqueous use solution comprising the liquid detergent concentrate composition, and to a method for washing textiles. The liquid detergent composition can be provided as a concentrate or as a use solution. The liquid detergent composition in the form of the concentrate or the use solution is an emulsion of the type water-in-oil emulsion or oil-in-water emulsion dependent on the amounts of water and oil in the emulsion.

BACKGROUND OF THE INVENTION

Liquid detergents are known from the state of the art. Such detergents are, for example, described in U.S. Pat. No. 5,880,083, WO 2004/065535 A1, and WO 2004/041990 A1. One problem in the formulation of liquid detergent is to develop formulations that can be judged satisfactory regarding the performance perspective, that is to remove the dirt without damaging tissue while the fabrics to impart a pleasant softness and to reduce the electrostatic charge between the fibers. On the other hand the emulsions need to be sufficiently viscous and stable on storage, so that even under temperature stress over several months, neither the viscosity collapses nor phase separation occurs.

The document WO 2007/101470 describes a liquid detergent composition which is storage-stable and shows a good washing performance. As non-ionic surfactants linear alkoxylated alcohols are used in the detergent composition. These are, for example, linear fatty alcohol ethoxylates having a $C_{13}$-$C_{15}$ alkyl group and 7 EO units. These liquid detergent concentrate compositions according to the state of art comprised about 1-70 wt.-% of said alkoxylated fatty alcohol. These liquid detergent compositions contain solubilizers which are able to keep the components in solution and the resulting emulsion stable even over a longer storage time. This was achieved by the use of one or more cross-linked or partly cross-linked polyacrylic acids and/or polymethacrylic acids in the composition.

These substances are used as thickener and stabiliser for a liquid detergent concentrate composition which represent an emulsion. These polyacrylic acid or polymethacrylic acid may be cross-linked or partly cross-linked with a polyalkenyl polyether compound as crosslinker. Those compounds are available under the trade name Carbopol® from Noveon.

The drawback of the prior art compositions is the production process to introduce the cross-linked or partly cross-linked polyacrylic acid/polymethacrylic acid thickener and stabilisers into the emulsion. The production process of the emulsions of the state of art requires the use of a premix to introduce the thickening polymer, i.e. the solid cross-linked or partly cross-linked polyacrylic acid/polymethacrylic acid, into the formula. This premix is both expensive and time-consuming due to the nature of the addition, which also involves a milling step. Within the premix, a powder eductor recirculates a liquid surfactant to which the powder polymer is added. This premix is then added to the rest of the emulsion. Therefore it was the aim of the present invention to replace this stabilizing system with one that is easier to handle.

SUMMARY OF THE INVENTION

Hence the technical object of the present invention was to provide low viscous liquid detergent concentrate compositions as emulsion comprising a stabilizing system involving an easier production process and which nevertheless are stable emulsions which do not or only slightly undergo phase separation during storage or when exposed to highly different temperature ranges.

The technical object of the invention is solved by a liquid detergent concentrate composition comprising an emulsion having a water phase and an oil phase, the composition comprising based on the whole concentrate:

(A) 1-50 wt.-% of a source of alkalinity;

(B) 1-70 wt.-% of a at least one non-ionic surfactant;

(C) 0.1-10 wt.-% of a copolymer of (1) at least one monomer of the formula (I):

$$H_2C{=}C(R^1){-}COOH,$$

wherein $R^1$ is a linear or branched $C_1$-$C_6$ alkyl or phenyl group; and (2) at least one monomer of (meth)acrylic acid ($C_1$-$C_6$) alkyl or phenyl ester;

(D) 0.1-10 wt.-% of a copolymer of (i) acrylic and/or methacrylic acid;

(ii) at least one monomer of the formula (III):

$$H_2C{=}C(R^3){-}C(O){-}O{-}(CH_2CH_2O)_n{-}R^4,$$

wherein $R^3$ is H or $CH_3$, n is at least 2 and preferably has an average value of at least 10, preferably 10 to 70, 10 to 60, 10 to 30, and $R^4$ is a hydrophobic group containing 8 to 24 carbon atoms; and (iii) at least one monomer of $C_1$-$C_4$ alkyl (meth)acrylate.

In a preferred embodiment the composition comprising based on the whole concentrate:

(A) 1-50 wt.-% of a source of alkalinity;

(B) 1-70 wt.-% of a at least one non-ionic surfactant;

(C) 0.1-10 wt.-% of a copolymer of (1) 10-90 wt.-% of at least one monomer of the formula (I):

$$H_2C{=}C(R^1){-}COOH,$$

wherein $R^1$ is a linear or branched $C_1$-$C_6$ alkyl or phenyl group; and (2) 10-90 wt.-% of at least one monomer of the formula (II):

$$H_2C{=}CH{-}C(O)OR^2,$$

wherein $R^2$ is a linear or branched $C_1$-$C_6$ alkyl or phenyl group;

(D) 0.1-10 wt.-% of a copolymer of (i) 30-45 wt.-% of (meth)acrylic acid;

(ii) 1-15 wt.-% of at least one monomer of the formula (III):

$$H_2C{=}C(R^3){-}C(O){-}O{-}(CH_2CH_2O)_n{-}R^4,$$

wherein $R^3$ is H or $CH_3$, n has an average value of 10-60 and $R^4$ is a $C_{12}$-$C_{18}$ alkyl group; and (iii) 40-60 wt.-% of at least one monomer of $C_1$-$C_4$ alkyl (meth)acrylate.

Preferably, monomers (1) and (2) of component (C) together represent 100 wt.-% in the copolymer of component (C). Further preferred, the component (C) is a copolymer of (1) 10-90 wt.-% of methacrylic acid; and (2) 10-90 wt.-% of at least one monomer of the formula (II):

$$H_2C{=}CH{-}C(O)OR^2,$$

wherein $R^2$ is $C_1$-$C_4$ alkyl.

Preferably, monomers (i), (ii) and (iii) of component (D) together represent 100 wt.-% in the copolymer of component (D). In yet a further embodiment of the present invention component (D) is a copolymer of (i) 30-45 wt.-% of methacrylic acid;

(ii) 1-15 wt.-% of at least one monomer of the formula (III):

$$H_2C{=}C(R^3){-}C(O){-}O{-}(CH_2CH_2O)_n{-}R^4,$$

wherein $R^3$ is H or $CH_3$, n has an average value of 10-60 and $R^4$ is a $C_{12}$-$C_{18}$ alkyl group; and (iii) 40-60 wt.-% of ethyl acrylate.

In a still further preferred embodiment of the liquid detergent concentrate component (D) is a copolymer of (i) 30-45 wt.-% of methacrylic acid;

(ii) 1-15 wt.-% of stearyloxypoly (ethyleneoxy)$_{20}$ethyl methacrylate; and (iii) 40-60 wt.-% of ethyl acrylate.

The skilled person understands that the liquid detergent concentrate composition optionally includes further ingredients and that the rest up to 100 wt.-% is water. One of the optional further ingredients is a defoamer.

The present invention provides a low viscous liquid detergent compositions in the form of an emulsion which comprises a stabilizing system involving an easier and less costly production method and which nevertheless represents stable emulsions. The use of a mixture of two acrylic polymers, component (C) and component (D), in a liquid detergent composition surprisingly showed that the traditionally used cross-linked or partly cross-linked polyacrylic acid/polymethacrylic acid could be replaced. Component (C) and component (D) are provided as liquid emulsions of the active polymer that can be readily introduced to the mix tank without the need for a premix or a milling step.

The new emulsion formula for the liquid detergent concentrate composition according to the present invention containing component (C) and component (D) provides decreased production time and thereby cost-savings versus the state of art production method.

In a preferred embodiment of the liquid detergent concentrate composition the non-ionic surfactant is a synthetic or natural alcohol that is alkoxylated with ethylene and/or propylene and/or butylenes oxide to yield a $C_6$-$C_{24}$ alcohol ethoxylate and/or propoxylate and/or butoxylate, preferably $C_6$-$C_{14}$ alcohol ethoxylate and/or propoxylate and/or butoxylate having 1 to 20 alkylene oxide groups, preferably 2 to 20 alkylene oxide groups; $C_6$-$C_{24}$ alkylphenol ethoxylates, preferably $C_8$-$C_{10}$ alkylphenol ethoxylates having 1 to 100 ethylene oxide groups, preferably about 12 to about 20 ethylene oxide groups; and $C_6$-$C_{24}$ alkylpolyglycosides, preferably $C_6$-$C_{20}$ alkylpolyglycosides having 1 to 20 glycoside groups, preferably 9 to 20 glycoside groups.

In a preferred embodiment of the liquid detergent concentrate composition the non-ionic surfactant is at least one alkoxylated fatty alcohol of the formula (IV) $R^5{-}(OC_2H_4)_x{-}(OC_3H_6)_y{-}OH$, wherein $R^5$ is a linear or branched $C_6$-$C_{24}$ alkyl or alkenyl group, x is 0 to 18 and y is 0 to 10 and the sum of x and y is at least 2 and one of x or y may be 0.

In another preferred embodiment the non-ionic surfactant is at least one ethoxylated and/or propoxylated fatty alcohol of the formula (IV) $R^5{-}(OC_2H_4)_x{-}(OC_3H_6)_y{-}OH$, wherein $R^5$ is a linear or branched $C_8$-$C_{18}$ alkyl or alkenyl group, x is 0 to 10 and y is 0 to 10 and the sum of x and y is at least 2 and one of x or y may be 0.

In still a further preferred embodiment the non-ionic surfactant is at least one ethoxylated and/or propoxylated fatty alcohol of the formula (IV) $R^5{-}(OC_2H_4)_x{-}(OC_3H_6)_y{-}OH$, wherein $R^5$ is a linear or branched $C_9$-$C_{16}$ alkyl or alkenyl group, x is 3 to 10 and y is 3 to 10 and the sum of x and y is at least 3 and one of x or y may be 0.

In another aspect of the present invention the non-ionic surfactant is at least one ethoxylated fatty alcohol of the formula (V) $R^6{-}(OC_2H_4)_m{-}OH$, wherein $R^6$ is a linear or branched $C_9$-$C_{16}$ alkyl or alkenyl group and m is 3 to 10.

In yet another embodiment the non-ionic surfactant is at least one ethoxylated fatty alcohol of the formula (V) $R^6{-}(OC_2H_4)_m{-}OH$, wherein $R^6$ is a linear or branched $C_{11}$-$C_{16}$ alkyl or alkenyl group and m is 5 to 10.

In a particular embodiment of the present invention the non-ionic surfactant is at least one alkoxylated alcohol of the formula (V) $R^6{-}(OC_2H_4)_m{-}OH$, wherein $R^6$ is iso-tridecyl group and m is 6 to 12, preferably m is 6 to 10, most preferred m is 8.

In a further embodiment of the present invention the non-ionic surfactant is at least one ethoxylated guerbet alcohol of the formula (V) $R^6{-}(OC_2H_4)_m{-}OH$, wherein $R^6$ is a branched $C_9$-$C_{20}$ alkyl group, preferably a branched $C_9$-$C_{18}$ alkyl group, further preferred a branched $C_9$-$C_{15}$ alkyl group, more preferred a branched $C_9$-$C_{11}$ alkyl group, most preferred a branched $C_{10}$ alkyl group and m is from 2 to 10, preferably 2 to 6.

According to the present invention the liquid detergent concentrate composition comprises a source of alkalinity which preferably includes alkali metal hydroxides, alkali metal carbonates, alkali metal silicates, alkali metal salts, phosphates, amines, and mixtures thereof, more preferably alkali metal hydroxides including sodium hydroxide, potassium hydroxide, and lithium hydroxide or mixtures thereof, and most preferred sodium hydroxide and/or potassium hydroxide.

In a further preferred embodiment the detergent concentrate composition has a viscosity range of from 1 to 3000 mPas, preferably 1 to 1500 mPas, further preferred 1 to 1000 mPas, at 20° C. measured at 20 revolutions per minute on a Brookfield RVT viscosimeter with spindle #2.

Preferably, the liquid detergent concentrate composition additionally comprises additives selected from the group consisting of complexing agents, builders, pH modifiers, antimicrobial agents, abrasives, anti-redeposition agents, sequestrants, softener, conditioner, viscosity modifying agents, wetting modifying agents, enzymes, optical brighteners, defoamers, and mixtures thereof.

The present invention also provides a system comprising a first component and a second component, wherein the first component is the liquid detergent concentrate composition as described above and the second component is containing a bleaching composition.

In a preferred embodiment the bleaching composition comprises a peracid selected from:

a) peracids corresponding to general formula (VI) $R^7{-}O_2C{-}(CH_2)_p{-}CO_3H$, wherein $R^7$ is hydrogen or an alkyl group containing 1 to 4 carbon atoms and p is an integer from 1 to 4, or salts thereof;

b) phthalimidopercarboxylic acids (VII) wherein the percarboxylic acid contains 1 to 18 carbon atoms, or salts thereof;

c) compounds corresponding to formula (VIII) $R^8$—$CO_3H$, wherein $R^8$ is an alkyl or alkenyl group containing 1 to 18 carbon atoms.

In a further preferred embodiment the bleaching composition comprises a peracid selected from:

a) peracids corresponding to general formula (VI) $R^7$—$O_2C$—$(CH_2)_p$—$CO_3H$, wherein $R^7$ is hydrogen or methyl group and p is an integer from 1 to 4, or salts thereof;

b) phthalimidopercarboxylic acids (VII) wherein the percarboxylic acid contains 1 to 8 carbon atoms, or salts thereof;

c) compounds corresponding to formula (VIII) $R^8$—$CO_3H$, wherein $R^8$ is an alkyl or alkenyl group containing 1 to 12 carbon atoms.

Further preferred the peracid is selected from peracetic acid, perpropionic acid, peroctanoic acid, phthalimidoperhexanoic acid, phthalimidoperoctanoic acid, persuccinic acid, persuccinic acid monomethyl ester, perglutaric acid, perglutaric acid monomethyl ester, peradipic acid, peradipic acid monomethyl ester, persuccinic acid, and persuccinic acid monomethyl ester.

In a still further preferred embodiment the bleaching composition comprises 1 to 30 wt.-% of peracid.

In another preferred embodiment the bleaching composition additionally contains 0.01 to 35 wt.-% of hydrogen peroxide.

In a particularly preferred embodiment the bleaching composition comprises at least a mixture of hydrogen peroxide, peracid and the corresponding acid. It is most preferred that the bleaching composition comprises at least hydrogen peroxide, peroxyacetic acid and acetic acid.

The present invention also provides a method for washing textiles comprising providing the liquid detergent concentrate composition as described above;

diluting the liquid detergent to a stable aqueous use solution to a concentration of 0.5 to 25 wt.-% based on the total use solution;

optionally, adding a bleaching composition as defined above to the liquid detergent concentrate composition or to the use solution;

washing the textiles in an institutional or a household washing machine in the use solution.

DETAILED DESCRIPTION OF THE INVENTION

The present invention refers to a liquid detergent concentrate composition comprising an emulsion having a water phase and an oil phase, the composition comprising based on the whole concentrate:

(A) 1-50 wt.-% of a source of alkalinity;

(B) 1-70 wt.-% of a at least one non-ionic surfactant;

(C) 0.1-10 wt.-% of a copolymer of (1) at least one monomer of the formula (I):

$H_2C{=}C(R^1)$—COOH, wherein $R^1$ is a linear or branched $C_1$-$C_6$ alkyl or phenyl group; and (2) at least one monomer of (meth)acrylic acid ($C_1$-$C_6$) alkyl or phenyl ester;

(D) 0.1-10 wt.-% of a copolymer of (i) acrylic and/or methacrylic acid;

(ii) at least one monomer of the formula (III):

$H_2C{=}C(R^3)$—C(O)—O—$(CH_2CH_2O)_n$—$R^4$, wherein $R^3$ is H or $CH_3$, n is at least 2 and preferably has an average value of at least 10, preferably 10 to 70, 10 to 60, 10 to 30, and $R^4$ is a hydrophobic group containing 8 to 24 carbon atoms; and (iii) at least one monomer of $C_1$-$C_4$ alkyl (meth)acrylate;

(E) optionally further ingredients, preferably 0.01 wt.-% to 20 wt.-%, further preferred 0.01 wt.-% to 5 wt.-% of a defoamer;

and the rest up to 100 wt.-% is water.

The liquid detergent concentrate composition according to the invention is a stable emulsion which does not separate when being stored. The emulsion is also stable at lower temperatures, for example −5° C. If the emulsion is frozen at temperatures below −10° C. and melted thereafter, the emulsion is formed again without stirring the composition. This is particularly important when the emulsion is stored outside for example in wintertime where outside temperatures are lower than −5° C. Even under these extreme conditions the liquid detergent concentrate composition according to the invention is a stable emulsion, does not separate and recovers completely at ambient temperatures.

Usually the detergent composition is made available as a concentrate and/or shipped or stored as a concentrate in order to avoid the expense associated with shipping and/or storing a composition containing a large amount of water. The concentrate is then normally diluted at the location of use to provide a use solution. Furthermore it is also possible that the concentrate is first diluted to provide a more dilute concentrate and then a ready-to-use composition is prepared by further diluting the diluted concentrate.

As mentioned above, the inventors have surprisingly found a new stabilizing for liquid detergent concentrate composition. The inventors found that when using two acrylic polymers, component (C) and component (D), the traditionally used cross-linked or partly cross-linked polyacrylic acid/polymethacrylic acid could be replaced. Component (C) and component (D) are provided as liquid emulsions of the active polymer that can be readily introduced to the mix tank without the need for a premix or a milling step.

As component (C) a copolymer may be used of (1) a monomer of the formula (I) $H_2C{=}C(R^1)$—COOH, wherein $R^1$ is a linear or branched $C_1$-$C_6$ alkyl or phenyl group, and (2) a monomer of the formula (II) $H_2C{=}CH$—C(O)$OR^2$, wherein $R^2$ is a linear or branched $C_1$-$C_6$ alkyl or phenyl group. The term "$C_1$-$C_6$ alkyl" means an alkyl group having 1 to 6 carbon atoms. $C_1$-$C_6$ alkyl group include methyl group, ethyl group, n-propyl group, isopropyl group, n-butyl group, isobutyl group, sec-butyl group, tert-butyl group, n-pentyl group, isopentyl group, neopentyl group, 1,1-dimethylpropyl group, n-hexyl group, and isohexyl group. The term "$C_1$-$C_6$ alkyl" also includes "$C_3$-$C_6$ cycloalkyl" which means a saturated carboxylic ring, having 3 to 6 carbon atoms, such as cyclopropyl group, cyclobutyl group, cyclopentyl group, cyclohexyl group.

In a preferred embodiment monomer (1) is methacrylic acid. A suitable copolymer is ACUSOL® 810 (Dow Chemicals). ACUSOL® 810 is a polymer synthesized from acid and acrylate co-monomers. ACUSOL® 810 is an alkali soluble acrylic polymer emulsion (ASE) and can be directly incorporated into formulations without preparation of a separate thickener solution. The viscosity is developed simply by adjusting the pH on the alkaline side with any base. ACUSOL® 810 contains carboxylic groups that immediately swell upon neutralization. Without being bound to any theory ACUSOL® 810 polymers thicken via a non-associative mechanism. Non-associative rheology modifiers do not interact with surfactant structures, particulates or insoluble emulsion droplets. Non-associative polymers thicken by structuring the continuous phase and through chain entanglement.

Unless the context clearly indicates otherwise, the term "(meth)acrylic" in the following description means, optionally, an acrylic or methacrylic acid, ester or polymer.

Component (D) is an acrylic or methacrylic acid emulsion copolymer characterized by the inclusion of a hydrophobe containing monomer. Component (D) is a thickener which is useful for thickening a wide variety of aqueous systems. The (meth)acrylic acid copolymer component (D) is a water insoluble emulsion copolymer of:

(i) acrylic and/or methacrylic acid;

(ii) a (meth)acrylic acid ester of a ($C_8$-$C_{24}$) alkyl monoether of a polyethylene glycol having at least two oxyethylene units therein, of the formula (III): $H_2C{=}C(R^3){-}C(O){-}O{-}(CH_2{-}CH_2O)_n{-}R^4$, wherein $R^3$ is H or $CH_3$, the latter being preferred, n is at least 2 and preferably has an average value of at least 10, up to 40 to 60 or even up to 70 or more, and $R^4$ is a hydrophobic group containing 8-24 carbon atoms, preferably 12 to 18 carbon atoms;

(iii) a ($C_1$-$C_4$)alkyl (meth)acrylate, preferably ethyl acrylate.

The copolymer (component (D)) is an alkali soluble and alkali thickenable material. This means that, for the purposes of this specification, the addition of an alkali to an aqueous dispersion containing the water insoluble emulsion copolymer (in an amount to at least partially neutralize the copolymer) will dissolve the copolymer and simultaneously cause the copolymer to swell and thereby to thicken the dispersion.

The copolymer should have a weight average molecular weight of about 100,000 to several million and therefore is prepared by emulsion polymerization to a solids content of about 25 to 50 wt.-%. The monomer components (i) to (iii) above may be used, respectively, in the ranges of (i) 20-50 wt.-%, (ii) 0.5 to 25 wt.-%, (iii) at least 30 wt.-%, the percentages of all monomers totaling 100 percent. Preferred ranges are (i) 30-45 wt.-%, (ii) 1-15 wt.-%, and (iii) 40-60 wt.-%, respectively.

Typically, $R^4$ may be alkyl ($C_8$-$C_{24}$), aralkyl or the residue of a polycyclic hydrocarbyl compound. Alkyl groups include lauryl, tridecyl, myristyl, pentadecyl, cetyl, palmityl, stearyl and eicosyl. Mixtures may also be used, such as alkyl groups resulting from the ethoxylation of mixtures of lauryl, stearyl, cetyl and palmityl alcohols. Aralkyl groups include alkylphenyl groups such as octylphenyl and nonylphenyl.

As component (D) ACUSOL® 820 (Dow Chemicals) may be used. ACUSOL® 820 belongs to rheology modifiers that—without being bound to any theory—are able to thicken by two mechanisms that can act simultaneously and are synergistic, i.e. by the effect of charge-induced polyelectrolytic chain expansion and through association of the extended hydrophobe groups. Upon neutralization of the acid groups present in the ACUSOL® 820 molecules with inorganic bases or organic amines they become anionically charged and water-soluble. They dissolve and swell due to charge-charge repulsion and therefore thicken instantly. When the polymers swell the pendant hydrophobic groups are free to build associations with one another and with other hydrophobes available in the formulation, such as surfactants, particulates, emulsion droplets and dyes. This phenomenon creates a network structure that results in a significant viscosity build. These associative structures can also serve for stabilization and dispersion of the respective formulation.

As components (C) and (D) provide a new stabilizing system for the liquid detergent concentrate composition according to the present invention, said composition comprises less, preferably 0 to 0.3 wt.-%, further preferred 0 to 0.1 wt.-%, still further preferred 0 wt.-%, i.e. none of difficult to handle cross-linked or partly cross-linked polyacrylic acid or polymethacrylic acid or mixtures thereof. Such thickening and stabilizing agents used in the state of art for a liquid detergent concentrate compositions are for example available under the trade name Carbopol® from Noveon (The Lubrizol Corporation).

Viscosity

In a preferred embodiment the liquid detergent concentrate composition according to the present invention has a viscosity range of from 1 to 3000, 1 to 1500, 1 to 1000 mPas, at 20° C. measured at 20 revolutions per minute on a Brookfield RVT viscosimeter with spindle #2. The liquid detergent concentrate composition according to the invention preferably has a viscosity in the range of from 300 to 3000, 300 to 1500, 300 to 1000 mPas, further preferred 300 to 900 mPas, still further preferred 600 to 900 mPas, and most preferred from 700 to 900 mPas at 20° C. measured at 20 revolutions per minute on a Brookfield RVT viscosimeter with spindle no. 2. This low viscosity allows to pump the liquid detergent concentrate by using standard pumping devices and it is not necessary to use specific pumping devices for high-viscous liquids. Because of the low viscosity of the product, it can be dosed by usual standard peristaltic pumps which are much cheaper than pumps for higher viscous fluids.

Surfactants

The liquid detergent concentrate composition according to the present invention comprises from 1 to 70 wt.-% of a non-ionic surfactant. In preferred embodiments the compositions of the present invention include 5 to 30 wt.-%, further preferred 5 to 20 wt.-% and particularly preferred 5 to 18 wt.-% of a non-ionic surfactant.

Non-ionic surfactants suitable for use with the compositions of the present invention include synthetic or natural alcohols that are alkoxylated (with ethylene and/or propylene and/or butylenes oxide) to yield a variety of $C_6$-$C_{24}$ alcohol ethoxylates and/or propoxylates and/or butoxylates (preferably $C_6$-$C_{14}$ alcohol ethoxylates and/or propoxylates and/or butoxylates having 1 to 20 alkylene oxide groups (preferably 2 to 20 alkylene oxide groups); $C_6$-$C_{24}$ alkylphenol ethoxylates (preferably $C_8$-$C_{10}$ alkylphenol ethoxylates) having 1 to 100 ethylene oxide groups (preferably about 12 to about 20 ethylene oxide groups); and $C_6$-$C_{24}$ alkylpolyglycosides (preferably $C_6$-$C_{20}$ alkylpolyglycosides) having 1 to 20 glycoside groups (preferably 9 to 20 glycoside groups).

Suitable alkoxylated surfactants for use as surfactants include EO/PO block copolymers, such as the Pluronic® and reverse Pluronic® surfactants; alcohol alkoxylates, such as Dehypon® LS-54 (R-$(EO)_5(PO)_4$); wherein R represents a linear or branched fatty alcohol residue) and Dehypon® LS-36 (R-$(EO)_3(PO)_6$; wherein R represents a linear or branched fatty alcohol residue); and capped alcohol alkoxylates, such as Plurafac® LF221 and Tegoten® EC11; mixtures thereof, or the like. More specifically the composition of the present invention can include alkoxylated primary or secondary alcohol having from 6 to 24, preferably 6 to 22, more preferred 8 to 18 carbon atoms reacted with from 2 to 18 moles of ethylene, and/or propylene, and/or butylene oxide. In a preferred embodiment the non-ionic has from 3 to 18 moles of alkylene oxide, in another preferred embodiment from 3 to 10 moles of ethylene oxide, and in yet another preferred embodiment 7 to 8 moles of EO. These materials are commercially available and well-known non-ionic surfactants. The following materials are useful: lauryl alcohol ethoxylated with 3 moles of ethylene oxide (EO), coco alcohol ethoxylated with 3 moles EO, stearyl alcohol ethoxylated with 5 moles EO, mixed $C_{12}$-$C_{15}$ alcohol ethoxylated with 7 moles EO, mixed secondary $C_{11}$-$C_{15}$ alcohol ethoxylated with 7 moles EO, mixed $C_9$-$C_{11}$ linear alcohol ethoxylated with 6 moles EO and the like. In preferred embodiment the non-ionic has from 8 to 15 carbon atoms in the alkyl group. When this alkyl group is used a non-ionic is the mixed $C_{12}$-$C_{15}$ alcohol ethoxylated with 7 moles EO. In a further preferred embodiment it comprises the alcohol alkoxylates, particularly the alcohol ethoxylates and propoxylates, especially the mixed ethoxylates and propoxylates, particularly with 3-7 oxyethylene (EO) units and 3-7 oxypropylene (PO) units such as the alcohol Dehypon® available from Cognis Corporation, having 5 EO units and 4 PO units. In another preferred embodiment it comprises the alcohol alkoxylates, particularly $C_{12}$-$C_{15}$ alcohol (e.g. mixed $C_{13}/C_{15}$ alcohol, iso-tridecanol), particularly with 3-20 oxyethylene (EO) units, preferably with 5-12 oxyethylene (EO) units, further preferred with 5-10 oxyethylene (EO) units, in particular with 7 or 8 oxyethylene (EO) units, such as the Lutensol® TO available from BASF.

Suitable alkoxylated surfactants for use as surfactants further include a guerbet alcohol ethoxylate of the formula $R^6$—$(OC_2H_4)_m$—OH, wherein $R^6$ is a branched $C_9$ to $C_{20}$ alkyl group, preferably a branched $C_9$ to $C_{18}$ alkyl group, further preferred a branched $C_9$-$C_{15}$ alkyl group, more preferred a branched $C_9$-$C_{11}$ alkyl group, most preferred a branched $C_{10}$ alkyl group and m is from 2 to 10, preferably 2 to 6. Such guerbet alcohols are available, for example, under the trade name Lutensol® XP or M from BASF or Eutanol® G from Cognis.

The guerbet reaction is a self-condensation of alcohols by which alcohols having branched alkyl chains are produced. The reaction sequence is related to the Aldol condensation and occurs at high temperatures under catalytic conditions. The product is a branched alcohol with twice the molecular weight of the reactant minus a mole of water. The reaction proceeds by a number of sequential reaction steps. At first the alcohol is oxidised to an aldehyde. Then Aldol condensation takes place after proton extraction. Thereafter the aldol product is dehydrated and the hydrogenation of the allylic aldehyde takes place.

These products are called guerbet alcohols and are further reacted to the non-ionic alkoxylated guerbet alcohols by alkoxylation with i.e. ethylene oxide or propylene oxide. The ethoxylated guerbet alcohols have a lower solubility in water compared to the linear ethoxylated alcohols with the same number of carbon atoms. Therefore the exchange of linear fatty alcohols by branched fatty alcohols makes it necessary to use good solubilizers which are able to keep the guerbet alcohol in solution and the resulting emulsion stable even over a longer storage time. This result is surprisingly achieved by the use of the stabilizing system (compound C and D) in the composition according to the present invention.

Alkaline Source

The liquid detergent composition comprises one or more alkalinity sources in an amount of 1 to 50 wt.-%, preferably 10 to 30 wt.-%. The source of alkalinity can be any source of alkalinity that is compatible with the other components of the cleaning composition. Exemplary sources of alkalinity include alkali metal hydroxides, alkali metal carbonates, alkali metal silicates, alkali metal salts, phosphates, amines, and mixtures thereof, preferably alkali metal hydroxides including sodium hydroxide, potassium hydroxide, and lithium hydroxide or mixtures thereof, and most preferred is sodium hydroxide and/or potassium hydroxide.

The liquid detergent concentrate composition according to the invention is as a concentrate as well as a use solution highly alkaline because it contains high amounts of an alkalinity sources. The alkalinity source controls the pH of the resulting solution when water is added to the detergent composition to form a use solution. The pH of the use solution must be maintained in the alkaline range in order to provide sufficient detergency properties. Further, the pH of the use solution is also useful for an optimized reduction in the germs count, such as bacteria, fungi, virus and spores, of the laundry washed with the detergent composition of the invention, preferably in combination with the second component of the invention. In a preferred embodiment, the pH of the use solution is between approximately 9 and approximately 14. Particularly, the pH of the use solution is between about 10 and about 14. More particularly, the pH of the use solution is between about 11 and about 14. In a particularly preferred embodiment, the pH of the use solution is from about 12 to about 13.5 and the pH of the concentrate is from about 13 to 14.

Exemplary alkali metal hydroxides include sodium hydroxide, potassium hydroxide, and lithium hydroxide. However, most preferred is sodium hydroxide.

Exemplary alkali metal salts include sodium carbonate, trisodium phosphate, potassium carbonate, and mixtures thereof.

Exemplary phosphates include sodium pyrophosphate, potassium pyrophosphate, and mixtures thereof.

Exemplary amines include alkanolamine selected from the group comprising triethanolamine, monoethanolamine, diethanolamine, and mixtures thereof.

The source of alkalinity, preferably an alkali metal hydroxide, may be added to the composition in a variety of forms, including for example in the form of solid beads, dissolved in an aqueous solution or a combination thereof. Alkali metal hydroxides are commercially available as pellets or beads having a mix of particle sizes, or as an aqueous solution, as for example, as about 45 wt.-%, about 50 wt.-% and about 73 wt.-% solution.

Other Additional Ingredients

The compositions of the present invention may include other additional ingredients. Additional ingredients suitable for use with the compositions of the present invention include, but are not limited to, acidulants, stabilizing agents, e.g., chelating agents or sequestrants, buffers, detergents, wetting agents, defoaming agents, thickeners, foaming agents, solidification agents, aesthetic enhancing agents (i.e., colorants, odorants, or perfumes) and other cleaning agents.

In a further preferred embodiment of present invention the liquid detergent concentrate composition additionally comprises additives selected from the group consisting of builder, pH modifier, antimicrobial agents, abrasives, anti-redeposition agents, sequestrants, softener, conditioner, viscosity modifying agents, wetting modifying agents, enzymes, optical brighteners, defoamers, and mixtures thereof.

These additional ingredients can be pre-formulated with the compositions of the invention or added to the system before, after, or substantially simultaneously with the addition of the compositions of the present invention. Additionally, the compositions can be used in conjunction with one or more conventional cleaning agents, e.g., an alkaline detergent.

Chelating/Sequestering Agent(s), Builders

The present invention refers to high alkaline compositions which also may include one or more chelating/sequestering agent(s) or builders. In general, a sequestrant chelating agent or builder is a molecule capable of coordinating (i.e., binding) the metal ions commonly found in natural water to prevent the metal ions from interfering with the action of the other detersive ingredients of a cleaning composition. For a further discussion of chelating agents/sequestrants, see Kirk-Othmer, Encyclopedia of Chemical Technology, Third Edition, volume 5, pages 339-366 and volume 23, pages 319-320.

Suitable sequestrants include, but are not limited to, organic chelating compounds that sequester metal ions in solution, particularly transition metal ions. Such sequestrants include organic amino- or hydroxy-polyphosphonic acid complexing agents (either in acid or soluble salt forms), carboxylic acids (e.g., polymeric polycarboxylate), hydroxycarboxylic acids, aminocarboxylic acids, or heterocyclic carboxylic acids, e.g., pyridine-2,6-dicarboxylic acid (dipicolinic acid).

Exemplary commercially available chelating/sequestering agent(s) include, but are not limited to: sodium gluconate (e.g. granular) and sodium tripolyphosphate (available from Innophos); Trilon® M available from BASF; Versene® 100, Low NTA Versene®, Versene® Powder, and Versenol® 120 all available from Dow; Dissolvine® D-40 and GL-38 available from Akzo; and sodium citrate.

In preferred embodiments of the compositions organic chelating/sequestering agent(s) may be used. Organic chelating/sequestering agent(s) include both polymeric and small molecule chelating/sequestering agent(s). Organic small molecule chelating/sequestering agent(s) are typically organocarboxylate compounds or organophosphate chelating/sequestering agent(s). Polymeric chelating/sequestering agent(s) commonly include polyanionic compositions such as polyacrylic acid compounds.

Small molecule organic chelating/sequestering agent(s) include aminocarboxylic acid type sequestrant. Suitable aminocarboxylic acid type sequestrants include the acids or alkali metal salts thereof, e.g., amino acetates and salts thereof. Suitable aminocarboxylates include N-hydroxyethylaminodiacetic acid; hydroxyethylenediaminetetraacetic acid, nitrilotriacetic acid (NTA); ethylenediaminetetraacetic acid (EDTA); N-hydroxyethyl-ethylenediaminetriacetic acid (HEDTA); diethylenetriaminepenta-acetic acid (DTPA); ethylenediamine-tetraproprionic acid triethylenetetraaminehexaacetic acid (TTHA), and alanine-N,N-diacetic acid; glutamic acid, N,N-diacetic acid (GLDA), methylglycinediacetic acid (MGDA), iminodisuccinate (IDS) and the like, and the respective alkali metal, ammonium and substituted ammonium salts thereof, and mixtures thereof.

Aminophosphonates are also suitable for use as chelating/sequestering agent(s) and include ethylenediaminetetramethylene phosphonates, nitrilotrismethylene phosphonates, and diethylenetriamine-(pentamethylene phosphonate) for example. These aminophosphonates commonly contain alkyl or alkenyl groups with less than 8 carbon atoms. Preferably, the sequestrant includes phosphonic acid or phosphonate salt. Suitable phosphonic acids and phosphonate salts include 1-hydroxy ethylidene-1,1-diphosphonic acid ($CH_3C(PO_3H_2)_2OH$) (HEDP); ethylenediamine tetrakis methylenephosphonic acid (EDTMP); diethylenetriamine pentakis methylenephosphonic acid (DETPMP); cyclohexane-1,2-tetramethylene phosphonic acid; amino[tri(methylene phosphonic acid)]; (ethylene diamine[tetra methylene-phosphonic acid)]; 2-phosphono butane-1,2,4-tricarboxylic acid; or salts thereof, such as the alkali metal salts, ammonium salts, or alkylol amine salts, such as mono, di, or tetra-ethanolamine salts; picolinic, dipicolinic acid or mixtures thereof.

Commercially available chelating agents include phosphonates sold under the trade name DEQUEST® from Thermphos or Cublen® from Zschimmer & Schwarz or Briquest® from Rhodia including, for example, 1-hydroxyethylidene-1,1-diphosphonic acid, as DEQUEST® 2010; amino(tri(methylenephosphonic acid)), ($N[CH_2PO_3H_2]_3$), available from Thermphos as DEQUEST® 2000 or from Zschimmer & Schwarz as Cublen® AP5 or from Rhodia as Briquest® 301-50A; ethylenediamine[tetra(methylenephosphonic acid)] available from Thermphos as DEQUEST® 2041; diethylenetriamine penta(methylenephosphonic acid) available as DEQUEST® 2066 from Thermphos or as Cublen® D 3217S from Zschimmer & Schwarz, and 2-phosphonobutane-1,2,4-tricarboxylic acid available from Lanxess as Bayhibit® AM.

Other suitable chelating/sequestering agent(s) include water soluble polycarboxylate polymers. Such homopolymeric and copolymeric chelating/sequestering agent(s) include polymeric compositions with pendant ($—CO_2H$) carboxylic acid groups and include polyacrylic acid, polymethacrylic acid, polymaleic acid, acrylic acid-methacrylic acid copolymers, acrylic-maleic copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, polymaleic acid, polyfumaric acid, copolymers of acrylic and itaconic acid, phosphino polycarboxylate, acid or salt forms thereof, or mixtures thereof. Water soluble salts or partial salts of these polymers or copolymers such as their respective alkali metal (for example, sodium or potassium) or ammonium salts can also be used. The weight average molecular weight of the polymers is from about 4000 to about 90,000. An example of commercially available polycarboxylic acids (polycarboxylates) is ACUSOL® 445 which is a homopolymer of acrylic acid with an average molecular weight of 4500 (Dow Chemicals). ACUSOL® 445 is available as partially neutralized, liquid detergent polymer. Sokalan® CP 5 is a acrylic acid/maleic acid copolymer available from BASF with a mean molar mass of 70000 g/mol.

In preferred embodiments, the total amount of chelating/sequestering agent(s) present in the composition of the present invention is from about 0.1 wt.-% to about 20 wt.-%, more preferred from about 0.5 wt.-% to about 12 wt.-%, further more preferred from about 1 wt.-% to about 12 wt.-%, particularly preferred from about 5 wt.-% to about 12 wt.-% and most preferred from 5 wt.-% to about 10 wt.-%. It is furthermore preferred, that the amount of chelating/sequestering agent(s) being polycarboxylate polymers in the composition of the present invention is from about 0.1 wt.-% to about 5 wt.-%, more preferred from about 0.5 wt.-% to about 5 wt.-% and particularly preferred from about 1 wt.-% to about 5 wt.-%. More preferred, the total amount of chelating/sequestering agent(s) present in the composition of the present invention is from about 1 wt.-% to about 12 wt.-%, wherein the amount of chelating/sequestering agent(s) being polycarboxylate polymers in the composition of the present invention is from about 0.5 wt.-% to about 5 wt.-%. Most preferred, the total amount of chelating/sequestering agent(s) present in the composition of the present invention is from about 1 wt.-% to about 10 wt.-%, wherein the amount of chelating/sequestering agent(s) being polycarboxylate polymers in the composition of the present invention is from about 0.5 wt.-% to about 5 wt.-%.

Defoaming Agents

Generally, defoamers which can be used in accordance with the invention include silica and silicones; aliphatic acids or esters; alcohols; sulfates or sulfonates; amines or amides; halogenated compounds such as fluorochlorohydrocarbons; vegetable oils, waxes, mineral oils as well as their sulfonated or sulfated derivatives; fatty acids and/or their soaps such as alkali, alkaline earth metal soaps; and phosphates and phosphate esters such as alkyl and alkaline diphosphates, and tributyl phosphates among others; and mixtures thereof.

One of the more effective antifoaming agents includes silicones. Silicones such as dimethyl silicone, glycol polysiloxane, methylphenol polysiloxane, trialkyl or tetralkyl silanes, hydrophobic silica defoamers and mixtures thereof can all be used in defoaming applications. Commercial defoamers commonly available include silicones such as Ardefoam® from Armour Industrial Chemical Company which is a silicone bound in an organic emulsion; Foam Kill® or Kresseo® available from Krusable Chemical Company which are silicone and non-silicone type defoamers as well as silicone esters; and Anti-Foam A® and DC-200 from Dow Corning Corporation. These defoamers can be present at a concentration range from about 0.01 wt.-% to about 20 wt.-%, from about 0.01 wt.-% to about 5 wt.-%, from about 0.01 wt.-% to about 4 wt.-%, from about 0.01 wt.-% to about 3 wt.-%, from about 0.01 wt.-% to about 2 wt.-%, from about 0.01 wt.-% to about 1.5 wt.-%, or from about 0.01 wt.-% to about 1 wt.-%.

Other defoamers that can be used in preferred embodiments of the invention include organic amides such as Antimussol® from Clariant or oil and/or polyalkylene based compounds such as Agitan® from Münzing or branched fatty alcohols such as Isofol® from Sasol.

The compositions of the present invention may further include antifoaming agents or defoaming agents which are based on alcohol alkoxylates that are stable in alkaline environments and are oxidatively stable. To this end one of the more effective antifoaming agents are the alcohol alkoxylates having an alcohol chain length of about $C_8$-$C_{12}$, and more specifically $C_9$-$C_{11}$, and having poly-propylene oxide alkoxylate in whole or part of the alkylene oxide portion. Commercial defoamers commonly available of this type include alkoxylates such as the BASF Degressal's; especially Degressal SD20.

Furthermore so called cloud point defoamers (typically non-ionic surfactants consisting of ethoxylated/propoxylated alcohols) may be used in the present invention such as Plurafac® types from BASF or Dehypon® types from Cognis.

Thickening or Gelling Agents

The compositions of the present invention can include any of a variety of known thickeners. Suitable thickeners include natural gums such as xanthan gum, guar gum, or other gums from plant mucilage; polysaccharide based thickeners, such as alginates, starches, and cellulosic polymers (e.g., carboxymethyl cellulose); polyacrylates thickeners; and hydrocolloid thickeners, such as pectin. Other suitable thickeners include synthetic materials, for example, polyacrylates, polyacrylamides, polyalkylene glycols and derivatives including polyethylene glycols or polypropylene glycols, polyvinyl derivatives such as polyvinyl alcohols and/or polyvinyl acetates, or co-polymers thereof, and other polyvinyl derivatives, and mixtures thereof. Polycarboxylic acids are also useful as thickening agents in compositions of the invention. ACUSOL® 445 is a partially neutralized, liquid detergent polymer. Other polyacrylic acids of molecular weight 4500 (CRITERION 2005) and 8000 (CRITERION 2108) can be purchased from Kemira Chemicals, Kennesaw, Ga. Other thickening agents include, but are not limited to, Sokalan CP5 available from BASF, Coatex DE185, Isol Dispersant HN44, Acusol® types from Dow Chemicals such as Acusol® 805S or Acusol® 830. In some embodiments, the thickener included is non oxidizable and storage stable under the pH conditions of the invention. In an embodiment, the thickener does not leave contaminating residue on the surface of an object. For example, the thickeners or gelling agents can be compatible with food or other sensitive products in contact areas. Generally, the concentration of thickener employed in the present compositions or methods will be dictated by the desired viscosity within the final composition. However, as a general guideline, the amount of thickener within the present composition ranges from about 0.1 wt.-% to about 5 wt.-%, from about 0.1 wt.-% to about 1.0 wt.-%, or from about 0.1 wt.-% to about 0.5 wt.-%.

Additional Function Ingredients

The compositions may include additional functional ingredients. Additional functional ingredients suitable for inclusion in the compositions include, but are not limited to, optical brighteners, soil antiredeposition agents, antifoam agents, low foaming surfactants, defoaming surfactants, pigments and dyes, softening agents, anti-static agents, anti-wrinkling agents, dye transfer inhibition/color protection agents, odor removal/odor capturing agents, soil shielding/soil releasing agents, ultraviolet light protection agents, fragrances, sanitizing agents, disinfecting agents, water repellency agents, insect repellency agents, anti-pilling agents, souring agents, mildew removing agents, allergicide agents, and mixtures thereof. In some embodiments, the additional functional ingredient or ingredients is formulated in the compositions. In other embodiments, the additional functional ingredient or ingredients is added separately during a cleaning process.

Color Stabilizing Agent

The compositions optionally include a color stabilizing agent. A color stabilizing agent can be any component that is included to inhibit discoloration or browning of the composition. In some embodiments, a color stabilizing agent may be included in the compositions at an amount of from about 0.01 to about 5 wt.-%, from about 0.05 to about 3 wt.-%, and from about 0.10 to about 2 wt.-%.

Optical Brighteners

The detergent compositions can optionally include an optical brightener, also referred to as a fluorescent whitening agent or a fluorescent brightening agent. Brighteners are added to laundry detergents to replace whitening agents removed during washing and to make the clothes appear cleaner. Optical brighteners may include dyes that absorb light in the ultraviolet and violet region (usually 340-370 nm) of the electromagnetic spectrum, and re-emit light in the blue region (typically 420-470 nm). These additives are often used to enhance the appearance of the color of a fabric, causing a perceived "whitening" effect, making materials look less yellow by increasing the overall amount of blue light reflected.

Fluorescent compounds belonging to the optical brightener family are typically aromatic or aromatic heterocyclic materials often containing a condensed ring system. A feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (naphthalamides, triazines, etc.). The choice of optical brighteners for use in compositions will depend upon a number of factors, such as the type of composition, the nature of other components present in the composition, the temperature of the wash water, the degree of agitation, and the ratio of the material washed to the tub size. The brightener selection is also dependent upon the type of material to be cleaned, e.g., cottons, synthetics, etc. Because most laundry detergent products are used to clean a variety of fabrics, the detergent compositions may contain a mixture of brighteners which are effective for a variety of fabrics. It is of course necessary that the individual components of such a brightener mixture be compatible.

Examples of suitable optical brighteners are commercially available and will be appreciated by those skilled in the art. At least some commercial optical brighteners can be classified into subgroups, including, but are not limited to: derivatives of stilbene, pyrazoline, carboxylic acid, methinecyanines, dibenzothiophene-5,5-dioxide, azoles, 5- and 6-membered-ring heterocycles, and other miscellaneous agents. Examples of particularly suitable optical brightening agents include, but are not limited to: distyryl biphenyl disulfonic acid sodium salt, and cyanuric chloride/diaminostilbene disulfonic acid sodium salt. Examples of suitable commercially available optical brightening agents include, but are not limited to: Tinopal® 5 BM-GX, Tinopal® CBS-CL, Tinopal® CBS-X, Tinopal® DMS-X and Tinopal® AMS-GX, available from BASF. Examples of optical brighteners are also disclosed in "The Production and Application of Fluorescent Brightening Agents", M. Zahradnik, Published by John Wiley & Sons, New York (1982), the disclosure of which is incorporated herein by reference.

Suitable stilbene derivatives include, but are not limited to: derivatives of bis(triazinyl)amino-stilbene, bisacylamino derivatives of stilbene, triazole derivatives of stilbene, oxadiazole derivatives of stilbene, oxazole derivatives of stilbene, and styryl derivatives of stilbene.

One or more optical brighteners may be used in the compositions. In some embodiments, optical brighteners are included in the compositions at an amount of from about 0.1 to about 5 wt.-%, from about 0.15 to about 3 wt.-%, or from about 0.2 to about 2 wt.-%.

Soil Antiredeposition Agents

The compositions may include antiredeposition agents. Without wishing to be bound by any particular theory, it is thought that antiredeposition agents aid in preventing loosened soil from redepositing onto cleaned fabrics. Antiredeposition agents may be made from complex cellulosic materials such as carboxymethylcellulose (CMC), or synthetic materials such as polyethylene glycol and polyacrylates. In other embodiments, polyphosphate builders may be included as an antiredeposition agent.

Further Characteristics

In a further preferred embodiment the content of water in the liquid detergent concentrate composition is between 5 and 90 wt.-%, preferably 25 to 90 wt.-%.

Exemplary enzymes that can be used as the suspended particulate component include proteases, lipases, amylases, cellulases, oxydases, peroxydases, esterases, and mixtures thereof. The liquid detergent concentrate can include an enzyme in an amount of between about 0.1 wt.-% and about 10 wt.-%, and between about 1 wt.-% and about 5 wt.-%.

The liquid detergent concentrate can be diluted with water to provide the use solution. The step of diluting can take place by pumping into a water stream, aspirating into a water stream, pouring into water or by combining water with the concentrate. In a preferred embodiment the use solution comprises the liquid detergent concentrate according to the invention in a concentration of 0.5 to 25 wt.-%, preferably 1 to 10 wt.-% based on the detergent use solution.

Bleaching Composition

As the liquid detergent concentrate composition is preferably used as a detergent for institutional and industrial washing the liquid detergent concentrate composition as such does not contain any bleaching agents. In institutional and industrial washing processes the bleaching agent is normally dosed separately from the detergent. Only in powder household detergents bleaching agents are present.

The present invention therefore also provides a system comprising a first component and a second component, wherein the first component is represented by the liquid detergent concentrate according to the present invention and the second component is containing a bleaching composition.

In some aspects, the bleaching compositions include at least one oxidizing agent. The bleaching composition can include any of a variety of oxidizing agents, for example, hydrogen peroxide and/or any inorganic or organic peroxide or peracid. The oxidizing agent can be present at an amount effective to convert a carboxylic acid to a peroxycarboxylic acid. In some embodiments, the oxidizing agent can also have antimicrobial activity. In other embodiments, the oxidizing agent is present in an amount insufficient to exhibit antimicrobial activity.

In some embodiments, the bleaching compositions include about 0.001 wt.-% oxidizing agent to 60 wt.-% oxidizing agent. In other embodiments, the compositions of the invention include about 10 wt.-% to about 30 wt.-% oxidizing agent.

Examples of inorganic oxidizing agents include the following types of compounds or sources of these compounds, or alkali metal salts including these types of compounds, or forming an adduct therewith: hydrogen peroxide, urea-hydrogen peroxide complexes or hydrogen peroxide donors of: group 1 (IA) oxidizing agents, for example lithium peroxide, sodium peroxide; group 2 (IIA) oxidizing agents, for example magnesium peroxide, calcium peroxide, strontium peroxide, barium peroxide; group 12 (IIB) oxidizing agents, for example zinc peroxide; group 13 (IIIA) oxidizing agents, for example boron compounds, such as perborates, for example sodium perborate hexahydrate of the formula $Na_2[B_2(O_2)_2(OH)_4].6H_2O$ (also called sodium perborate tetrahydrate); sodium peroxyborate tetrahydrate of the formula $Na_2B_2(O_2)_2[(OH)_4].4H_2O$ (also called sodium perborate trihydrate); sodium peroxyborate of the formula $Na_2[B_2(O_2)_2(OH)_4]$ (also called sodium perborate monohydrate); group 14 (IVA) oxidizing agents, for example persilicates and peroxycarbonates, which are also called percarbonates, such as persilicates or peroxycarbonates of alkali metals; group 15 (VA) oxidizing agents, for example peroxynitrous acid and its salts; peroxyphosphoric acids and their salts, for example, perphosphates; group 16 (VIA) oxidizing agents, for example peroxysulfuric acids and their salts, such as peroxymonosulfuric and peroxydisulfuric acids, and their salts, such as persulfates, for example, sodium persulfate; and group VIIa oxidizing agents such as sodium periodate, potassium perchlorate. Other active inorganic oxygen compounds can include transition metal peroxides; and other such peroxygen compounds, and mixtures thereof.

Examples of organic oxidizing agents include, but are not limited to, perbenzoic acid, derivatives of perbenzoic acid, t-butyl benzoyl hydroperoxide, benzoyl hydroperoxide, or any other organic based peroxide and mixtures thereof, as well as sources of these compounds. Other examples include, but are not limited to, peracids including $C_1$-$C_{22}$ percarboxylic acids such as peracetic acid, performic acid, percarbonic acid, peroctanoic acid, and the like; per-diacids or per-triacids such as peroxalic acid, persuccinic acid, percitric acid, perglycolic acid, permalic acid and the like; and aromatic peracids such as perbenzoic acid, or mixtures thereof.

The compositions of the present invention may employ one or more of the inorganic oxidizing agents listed above. Suitable inorganic oxidizing agents include ozone, hydrogen peroxide, hydrogen peroxide adduct, group IIIA oxidizing agent, or hydrogen peroxide donors of group VIA oxidizing agent, group VA oxidizing agent, group VIIA oxidizing agent, or mixtures thereof. Suitable examples of such inorganic oxidizing agents include percarbonate, perborate, persulfate, perphosphate, persilicate, or mixtures thereof.

Carboxylic and Percarboxylic Acids

The bleaching compositions of the present invention may include at least one carboxylic and/or percarboxylic acid. In some embodiments, the compositions of the present invention include at least two or more carboxylic and/or percarboxylic acids.

In a preferred embodiments, the carboxylic acid for use with the compositions of the present invention includes a $C_1$ to $C_{22}$ carboxylic acid. Further preferred the carboxylic acid for use with the compositions of the present invention is a $C_1$ to $C_{12}$ carboxylic acid. The carboxylic acid for use with the compositions of the present invention in particular may be a $C_5$ to $C_{12}$ carboxylic acid. In particular preferred embodiments, the carboxylic acid for use with the compositions of the present invention is a $C_1$ to $C_4$ carboxylic acid. Examples of suitable carboxylic acids include, but are not limited to, formic, acetic, propionic, butanoic, pentanoic, hexanoic, heptanoic, octanoic, nonanoic, decanoic, undecanoic, dodecanoic, as well as their branched isomers, lactic, maleic, ascorbic, citric, hydroxyacetic, neopentanoic, neoheptanoic, neodecanoic, oxalic, malonic, succinic, glutaric, adipic, pimelic subric acid, and mixtures thereof.

The bleaching compositions of the present invention preferably include about 0.1 wt.-% to about 80 wt.-% of a carboxylic acid. In other embodiments, the compositions of the present invention include about 1 wt.-% to about 60 wt.-% of a carboxylic acid. In yet other embodiments, the compositions of the present invention include about 20 wt.-%, about 30 wt.-%, or about 40 wt.-% of a carboxylic acid. In further preferred embodiments, the compositions of the present invention include about 5 wt.-% to about 10 wt.-% of acetic acid. In other embodiments, the compositions of the present invention include about 5 wt.-% to about 10 wt.-% of octanoic acid. Further preferred, the bleaching compositions of the present invention include a combination of octanoic acid and acetic acid.

The bleaching compositions of the present invention preferably include at least one peroxycarboxylic acid. Peroxycarboxylic acids useful in the bleaching compositions include peroxyformic, peroxyacetic, peroxypropionic, peroxybutanoic, peroxypentanoic, peroxyhexanoic, peroxyheptanoic, peroxyoctanoic, peroxynonanoic, peroxydecanoic, peroxyundecanoic, peroxydodecanoic, or the peroxyacids of their branched chain isomers, peroxylactic, peroxymaleic, peroxyascorbic, peroxyhydroxyacetic, peroxyoxalic, peroxymalonic, peroxysuccinic, peroxyglutaric, peroxyadipic, peroxypimelic and peroxysubric acid and mixtures thereof. The bleaching compositions may utilize a combination of several different peroxycarboxylic acids. For example, in some embodiments, the composition includes one or more $C_1$ to $C_4$ peroxycarboxylic acids and one or more $C_5$ to $C_{12}$ peroxycarboxylic acids. In some embodiments, the $C_1$ to $C_4$ peroxycarboxylic acid is peroxyacetic acid and the $C_5$ to $C_{15}$ acid is peroxyoctanoic acid.

In preferred embodiments, the bleaching compositions include peroxyacetic acid. Peroxyacetic (or peracetic) acid is a peroxycarboxylic acid having the formula: $CH_3COOOH$. Generally, peroxyacetic acid is a liquid having an acrid odor at higher concentrations and is freely soluble in water, alcohol, ether, and sulfuric acid. Peroxyacetic acid can be prepared through any number of methods known to those of skill in the art including preparation from acetaldehyde and oxygen in the presence of cobalt acetate. A solution of peroxyacetic acid can be obtained by combining acetic acid with hydrogen peroxide. A 50% solution of peroxyacetic acid can be obtained by combining acetic anhydride, hydrogen peroxide and sulfuric acid.

In preferred embodiments, the bleaching compositions include peroxyoctanoic acid, peroxynonanoic acid, or peroxyheptanoic acid. In further preferred embodiments, the bleaching compositions include peroxyoctanoic acid. Peroxyoctanoic (or peroctanoic) acid is a peroxycarboxylic acid having the formula, for example, of n-peroxyoctanoic acid: $CH_3(CH_2)_6COOOH$. Peroxyoctanoic acid can be an acid with a straight chain alkyl moiety, an acid with a branched alkyl moiety, or a mixture thereof. Peroxyoctanoic acid can be prepared through any number of methods known to those of skill in the art. A solution of peroxyoctanoic acid can be obtained by combining octanoic acid and hydrogen peroxide and a hydrotrope, solvent or carrier.

Further preferred, the bleaching compositions include about 0.1 wt.-% to about 90 wt.-% of one or more peroxycarboxylic acids. In other embodiments, the bleaching compositions include about 1 wt.-% to about 25 wt.-% of one or more peroxycarboxylic acids. In yet other embodiments, the bleaching compositions include about 5 wt.-% to about 10 wt.-% of one or more peroxycarboxylic acids. In some embodiments, the bleaching compositions include about 1 wt.-% to about 25 wt.-% of peroxyacetic acid. In other embodiments, the bleaching compositions include about 0.1 wt.-% to about 10 wt.-% of peroxyoctanoic acid. In still yet other embodiments, the bleaching compositions include a mixture of about 5 wt.-% peroxyacetic acid, and about 1.5 wt.-% peroxyoctanoic acid.

In a preferred embodiment of the system of the present invention the bleaching composition comprises a peracid selected from:

a) peracids corresponding to general formula (VI) $R^7$—$O_2C$—$(CH_2)_p$—$CO_3H$, wherein $R^7$ is hydrogen or an alkyl group containing 1 to 4 carbon atoms and p is an integer from 1 to 4, or salts thereof;
b) phthalimidopercarboxylic acids (VII) wherein the percarboxylic acid contains 1 to 18 carbon atoms, or salts thereof;
c) compounds corresponding to formula (VIII) $R^8$—$CO_3H$, wherein $R^8$ is an alkyl or alkenyl group containing 1 to 18 carbon atoms.

In yet a further preferred embodiment of the system the bleaching composition comprises a peracid selected from:

a) peracids corresponding to general formula (VI) $R^7—O_2C—(CH_2)_p—CO_3H$, wherein $R^7$ is hydrogen or methyl group and p is an integer from 1 to 4, or salts thereof;

b) phthalimidopercarboxylic acids (VII) wherein the percarboxylic acid contains 1 to 8 carbon atoms, or salts thereof;

c) compounds corresponding to formula (VIII) $R^8—CO_3H$, wherein $R^8$ is an alkyl or alkenyl group containing 1 to 12 carbon atoms.

Further preferred, the peracid is selected from peracetic acid, perpropionic acid, peroctanoic acid, phthalimidoperhexanoic acid, phthalimidoperoctanoic acid, persuccinic acid, persuccinic acid monomethyl ester, perglutaric acid, perglutaric acid monomethyl ester, peradipic acid, peradipic acid monomethyl ester, persuccinic acid, and persuccinic acid monomethyl ester.

In a further preferred embodiment the bleaching composition comprises 1 to 30 wt.-% of peracid. Further preferred, the bleaching composition additionally contains 0.01 to 35 wt.-% of hydrogen peroxide. Still further preferred, the bleaching composition comprises at least a mixture of hydrogen peroxide, peracid and the corresponding acid. Most preferred, the bleaching composition comprises at least hydrogen peroxide, peroxyacetic acid and acetic acid.

The liquid detergent concentrate composition according to the invention is used for washing textiles. The method for washing textiles comprises providing the liquid detergent concentrate composition, diluting the liquid detergent concentrate composition to a stable aqueous use solution in a concentration of 0.5 to 25 wt.-%, preferably 1 to 10 wt.-% based on the whole use solution, optionally adding a bleaching composition to the liquid detergent concentrate composition or to the use solution, and washing the textiles in an institutional or household washing machine in the use solution.

The inventive composition and the method according to the invention will be further described in the following examples which are meant to exemplify the present invention without restricting its scope. In the following all amounts mentioned refer to wt.-% based on the whole liquid detergent concentrate composition unless otherwise indicated.

EXAMPLES

Example 1: Composition of the Detergent Concentrate

Tables 1 to 3 describe specific examples of the liquid detergent concentrate composition according to the invention. Examples 1 to 18 describe emulsions which are stable over a prolonged time-period at 20° C., 5° C. or 40° C. and after freeze-thaw cycles. Examples 1 to 18 contains a mixture of acrylic acid acrylate ester copolymer (ASE=alkali soluble emulsion) and acrylic acid acrylate copolymer including an ethoxylated hydrophobe (HASE=hydrophobically-modified alkali soluble emulsions).

Comparative example C1 describes liquid detergent compositions which contains cross-linked polyacrylic acid. Instead of the ASE/HASE mixture the comparative example comprises cross-linked polyacrylic acid as stabilizing system.

TABLE 1

Liquid detergent concentrate compositions; amounts given in wt.-%

| Ingredient* | 1 | 2 | 3 | 4 | 5 | 6 |
|---|---|---|---|---|---|---|
| distyryl biphenyl derivate (1) | 0.15 | 0.15 | 0.15 | 0.15 | 0.15 | 0.15 |
| optical brightener (2) | — | — | — | — | — | — |
| acrylic acid acrylate ester copolymer (3) | 3.00 | 2.50 | 2.00 | 2.75 | 3.00 | 3.25 |
| acrylic acid acrylate ester copolymer, hydrophobized (4) | 3.00 | 2.50 | 2.00 | 2.25 | 2.00 | 1.75 |
| crosslinked polyacrylic acid (15) | — | — | — | — | — | — |
| fatty alcohol C13 iso + 8 EO (5) | 12.00 | 12.00 | 12.00 | 12.00 | 12.00 | 12.00 |
| fatty alcohol C13-15 + 7 EO (6) | — | — | — | — | — | — |
| C10 guerbet alcohol + 3 EO (7) | — | — | — | — | — | — |
| fatty alcohol C12-14 + 5EO + 4 PO (8) | — | — | — | — | — | — |
| MGDA 40% (9) | 4.00 | 4.00 | 4.00 | 4.00 | 4.00 | 4.00 |
| GLDA 38% (10) | — | — | — | — | — | — |
| PBTC (11) | 1.50 | 1.50 | 1.50 | 1.50 | 1.50 | 1.50 |
| DETPMP 30%(12) | — | — | — | — | — | — |
| polycarboxylic acid 48% (13) | 3.00 | 3.00 | 3.00 | 3.00 | 3.00 | 3.00 |
| acrylic acid/maleic acid copolymer 40% (14) | — | — | — | — | — | — |
| defoamer (16) | — | — | — | — | — | — |
| sodium hydroxide solution 50% | 35.00 | 35.00 | 35.00 | 35.00 | 35.00 | 35.00 |
| deionized water | 38.35 | 39.35 | 40.35 | 39.35 | 39.35 | 39.35 |
| Sum | 100.0 | 100.0 | 100.0 | 100.0 | 100.0 | 100.0 |
| Viscosity (Brookfield RVT), Spindle #2, 20 rpm [mPas] | 2620 | 880 | 500 | 940 | 600 | 700 |

TABLE 2

Liquid detergent concentrate compositions; amounts given in wt.-%

| Ingredient* | 7 | 8 | 9 | 10 | 11 | 12 |
|---|---|---|---|---|---|---|
| distyryl biphenyl derivate (1) | 0.15 | 0.15 | 0.15 | 0.15 | 0.15 | 0.15 |
| optical brightener (2) | — | — | — | — | — | — |
| acrylic acid acrylate ester copolymer (3) | 4.00 | 3.33 | 2.92 | 3.00 | 2.50 | 2.66 |

TABLE 2-continued

| Liquid detergent concentrate compositions; amounts given in wt.-% | | | | | | |
|---|---|---|---|---|---|---|
| Ingredient* | 7 | 8 | 9 | 10 | 11 | 12 |
| acrylic acid acrylate ester copolymer, hydrophobized (4) | 2.00 | 1.67 | 2.08 | 3.00 | 2.50 | 1.34 |
| crosslinked polyacrylic acid (15) | — | — | — | — | — | — |
| fatty alcohol C13 iso + 8 EO (5) | 12.00 | 12.00 | 12.00 | 12.00 | 12.00 | 12.00 |
| fatty alcohol C13-15 + 7 EO (6) | — | — | — | — | — | — |
| C10 guerbet alcohol + 3 EO (7) | — | — | — | — | — | — |
| fatty alcohol C12-14 + 5EO + 4 PO (8) | — | — | — | — | — | — |
| MGDA 40% (9) | 4.00 | 4.00 | 4.00 | 4.00 | 4.00 | 4.00 |
| GLDA 38% (10) | — | — | — | — | — | — |
| PBTC (11) | 1.50 | 1.50 | 1.50 | 1.50 | 1.50 | 1.50 |
| DETPMP 30% (12) | — | — | — | — | — | — |
| polycarboxylic acid 48% (13) | 3.00 | 3.00 | 3.00 | 3.00 | 3.00 | 3.00 |
| acrylic acid/maleic acid copolymer 40% (14) | — | — | — | — | — | — |
| defoamer (16) | — | — | — | — | — | — |
| sodium hydroxide solution 50% | 40.00 | 40.00 | 40.00 | 40.00 | 40.00 | 40.00 |
| deionized water | 33.35 | 34.35 | 34.35 | 33.35 | 34.35 | 35.35 |
| Sum | 100.0 | 100.0 | 100.0 | 100.0 | 100.0 | 100.0 |
| Viscosity (Brookfield RVT), Spindle #2, 20 rpm [mPas] | 1460 | 780 | 980 | 1820 | 1140 | 480 |

TABLE 3

| Liquid detergent concentrate compositions; amounts given in wt.-% | | | | | | | |
|---|---|---|---|---|---|---|---|
| Ingredient* | 13 | 14 | 15 | 16 | 17 | 18 | C1 |
| distyryl biphenyl derivate (1) | 0.19 | 0.19 | 0.19 | 0.19 | 0.50 | 0.19 | 0.31 |
| optical brightener (2) | 0.83 | 0.83 | 0.83 | 0.83 | 0.13 | 0.83 | 0.19 |
| acrylic acid acrylate ester copolymer (3) | 2.13 | 2.13 | 2.13 | 2.13 | 2.50 | 2.00 | — |
| acrylic acid acrylate ester copolymer, hydrophobized (4) | 1.75 | 1.75 | 1.75 | 1.75 | 2.13 | 1.75 | — |
| crosslinked polyacrylic acid (15) | — | — | — | — | — | — | 0.75 |
| fatty alcohol C13 iso + 8 EO (5) | 17.50 | | | — | 15.00 | 17.50 | 15.00 |
| fatty alcohol C13-15 + 7 EO (6) | — | 17.50 | — | — | — | — | — |
| C10 guerbet alcohol + 30 EO (7) | — | — | 17.50 | — | — | — | — |
| fatty alcohol C12-14 + 5EO + 4 PO (8) | — | — | — | 17.50 | — | — | — |
| MGDA 40% (9) | 5.00 | — | 5.00 | 5.00 | 1.88 | 5.00 | 5.00 |
| GLDA 38% (10) | — | 5.00 | — | — | — | — | — |
| PBTC (11) | — | — | — | — | — | — | — |
| DETPMP 30% (12) | 6.25 | 6.25 | 6.25 | 6.25 | 5.00 | 6.25 | 3.75 |
| polycarboxylic acid 48% (13) | — | 2.50 | 2.50 | 2.50 | 3.75 | 2.50 | 3.75 |
| acrylic acid/maleic acid copolymer 40% (14) | 2.50 | — | — | — | — | — | — |
| defoamer (16) | — | — | — | — | — | 1.88 | — |
| sodium hydroxide solution 50% | 37.50 | 37.50 | 37.50 | 37.50 | 37.50 | 37.50 | 37.50 |
| deionized water | 26.36 | 26.36 | 26.36 | 26.36 | 31.63 | 24.61 | 33.75 |
| sum | 100.0 | 100.0 | 100.0 | 100.0 | 100.0 | 100.0 | 100.0 |
| Viscosity, (Brookfield RVT), Spindle #2, 20 rpm [mPas] | 635 | 768 | 945 | 722 | 819 | 739 | 919 |

Ingredient*: percentages indicate the wt.-% of the given substance in an aqueous solution
(1) Tinopal ® CBS-X (BASF)
(2) Tinopal ® DMS-X (BASF)
(3) Acusol ® 810 (Dow Chemicals)
(4) Acusol ® 820 (Dow Chemicals)
(5) Lutensol ® TO 8 (BASF)
(6) Lutensol ® AO 7 (BASF)
(7) Lutensol ® XP 30 (BASF)
(8) Dehypon ® LS54 (Cognis)
(9) methyl glycine diacetic acid, sodium salt; Trilon ® M (BASF)
(10) glutamic acid N,N-diacetic acid, tetra sodium salt; Dissolvine ® GL-38 (AkzoNobel)
(11) 2-phosphonobutane-1,2,4-tricarboxylic acid; Bayhibit ® AM (LANXESS)
(12) diethylene triamine penta (methylene phosphonic acid); Dequest ® 2066 (Dequest AG)
(13) polyacrylic acid; Acusol ® 445 (Dow Chemicals)
(14) Sokalan ® CP5 (BASF)
(15) Carbopol ® ETD 2691 (Noveon)
(16) Antimussol ® FN (Clariant)
(EO) = oxyethylene units
(PO) = oxypropylene units Example 2: Storage Stability In example 2 the storage stability of the compositions was tested. The liquid detergent concentrate compositions were stored for several days or weeks at different temperatures. Further, the compositions were subjected to up to 3 cycles of freezing/thawing. The stability is given as the volume percent of the total composition which underwent separation. The results of the test are shown in the following table 4. For the stability tests samples were placed in 100 ml glass jars and placed in 4° C., 5° C. or 40° C. storage chambers as well as on the shelf at room temperature (21° C.). After several days or weeks as indicated, the height of the separated layer was measured (in millimeters). The measurement was carried out from the bottom of the jar as the separation takes place on the bottom of the samples. The height of the separated layer was divided by the total height of the sample in order to obtain a percent (vol.-%) separation. Freeze/thaw tests were performed by placing the samples in 100 ml glass jars. The glass jars were placed in a 40° C. storage chamber for 1 day and then in a 5° C. storage chamber for 1 day. The freeze/thaw cycles were repeated two times. After each cycle, the samples were checked visually for separation and consistency.

TABLE 4

Storage stability of liquid detergent concentrate compositions

| stability given as separation [vol.-%] | 1 | 2 | 3 | 4 | 5 | 6 |
|---|---|---|---|---|---|---|
| room temperature, 12 days | 0.0 | 0.0 | 5.9 | 0.0 | 0.0 | 0.0 |
| 4° C., 12 days | 0.0 | 0.0 | 0.0 | 0.0 | 0.0 | 0.0 |
| 40° C., 12 days | 0.0 | 0.0 | 0.0 | 0.0 | 0.0 | 3.6 |
| freeze/thaw (3 cycles) | 0.0 | 0.0 | 0.0 | 0.0 | 0.0 | 0.0 |

| stability given as separation [vol.-%] | 7 | 8 | 9 | 10 | 11 | 12 |
|---|---|---|---|---|---|---|
| room temperature, 12 days | 0.0 | 0.0 | 0.0 | 0.0 | 0.0 | 7.2 |
| 4° C., 12 days | 0.0 | 0.0 | 0.0 | 0.0 | 0.0 | 0.0 |
| 40° C., 12 days | 0.0 | 0.0 | 0.0 | 0.0 | 0.0 | 5.6 |
| freeze/thaw (3 cycles) | 0.0 | 0.0 | 0.0 | 0.0 | 0.0 | 0.0 |

| stability given as separation [vol.-%] | 13 | 14 | 15 | 16 |
|---|---|---|---|---|
| room temperature, 28 days | 3.4 | 3.4 | 3.2 | 4.3 |
| 5° C., 28 days | 1.1 | 0.8 | 1.0 | 1.4 |
| 40° C., 28 days | 4.0 | 3.3 | 5.6 | 6.8 |
| freeze/thaw (1 cycle) | 0.0 | 0.0 | 0.0 | 0.4 |
| freeze/thaw (2 cycles) | 0.7 | 0.6 | 1.1 | 1.6 |
| freeze/thaw (3 cycles) | 1.2 | 0.9 | 1.4 | 1.9 |

| stability given as separation [vol.-%] | 17 | C1 | | 18 |
|---|---|---|---|---|
| room temperature (RT), 12 weeks | 2.9 | 5.4 | RT, 5 weeks | 2.5 |
| 5° C., 12 weeks | 1.3 | 1.5 | 5° C., 5 weeks | 1.3 |
| 40° C., 12 weeks | 5.8 | 6.3 | 40° C., 5 weeks | 4.8 |
| freeze/thaw (1 cycle) | 0.0 | 0.0 | | 0.0 |
| freeze/thaw (2 cycles) | 0.0 | 0.0 | | 0.6 |
| freeze/thaw (3 cycles) | 0.0 | 0.0 | | 0.0 |

The results show that the compositions according to the present invention 1-18 have the same or very similar storage stability compared to the prior art composition C1.

The invention claimed is:

1. Liquid detergent concentrate composition comprising an emulsion having a water phase and an oil phase, the composition comprising based on the whole concentrate:

(A) 20-50 wt.-% of a source of alkalinity, wherein the source of alkalinity include alkali metal hydroxides, alkali metal silicates, alkali metal salts, phosphates, amines and/or mixtures thereof;

(B) 1-70 wt.-% of at least one non-ionic surfactant;

(C) 0.1-10 wt.-% of a copolymer of (1) at least one monomer of the formula (I):

$$H_2C{=}C(R^1){-}COOH,$$

wherein $R^1$ is a linear or branched $C_1$-$C_6$ alkyl or phenyl group; and (2) at least one monomer of (meth)acrylic acid ($C_1$-$C_6$) alkyl or phenyl ester;

(D) 0.1-10 wt.-% of a copolymer of (i) acrylic and/or methacrylic acid;

(ii) at least one monomer of the formula (III):

$$H_2C{=}C(R^3){-}C(O){-}O{-}(CH_2CH_2O)_n{-}R^4,$$

wherein $R^3$ is H or $CH_3$, n is at least 2 and has an average value of at least 10, and $R^4$ is a hydrophobic group containing 8 to 24 carbon atoms; and (iii) at least one monomer of $C_1$-$C_4$ alkyl (meth)acrylate.

2. Liquid detergent concentrate composition comprising an emulsion having a water phase and an oil phase according to claim 1, the composition comprising based on the whole concentrate:

(A) 20-50 wt.-% of a source of alkalinity, wherein the source of alkalinity include alkali metal hydroxides, alkali metal silicates, alkali metal salts, phosphates, amines and/or mixtures thereof;

(B) 1-70 wt.-% of a at least one non-ionic surfactant;

(C) 0.1-10 wt.-% of a copolymer of (1) 10-90 wt.-% of at least one monomer of the formula (I):

$$H_2C{=}C(R^1){-}COOH,$$

wherein $R^1$ is a linear or branched C1-C6 alkyl or phenyl group; and (2) 10-90 wt.-% of at least one monomer of the formula (II):

$$H_2C{=}CH{-}C(O)OR^2,$$

wherein $R^2$ is a linear or branched $C_1$-$C_6$ alkyl or phenyl group;

(D) 0.1-10 wt.-% of a copolymer of (i) 30-45 wt.-% of (meth)acrylic acid;

(ii) 1-15 wt.-% of at least one monomer of the formula (III):

$$H_2C{=}C(R^3){-}C(O){-}O{-}(CH_2CH_2O)_n{-}R^4,$$

wherein $R^3$ is H or $CH_3$, n has an average value of 10-60 and $R^4$ is a $C_{12}$-$C_{18}$ alkyl group; and (iii) 40-60 wt.-% of at least one monomer of $C_1$-$C_4$ alkyl (meth)acrylate.

3. Liquid detergent concentrate composition according to claim 2, wherein (C) is a copolymer of (1) 10-90 wt.-% of methacrylic acid; and (2) 10-90 wt.-% of at least one monomer of the formula (II):

$$H_2C{=}CH{-}C(O)OR^2,$$

wherein $R^2$ is C1-C4 alkyl.

4. Liquid detergent concentrate composition according to claim 3, wherein (D) is a copolymer of (i) 30-45 wt.-% of methacrylic acid;

(ii) 1-15 wt.-% of at least one monomer of the formula (III):

$$H_2C{=}C(R^3){-}C(O){-}O{-}(CH_2CH_2O)_n{-}R^4,$$

wherein $R^3$ is H or $CH_3$, n has an average value of 10-60 and $R^4$ is a $C_{12}$-$C_{18}$ alkyl group; and (iii) 40-60 wt.-% of ethyl acrylate.

5. Liquid detergent concentrate composition according to claim 3, wherein (D) is a copolymer of (i) 30-45 wt.-% of methacrylic acid;

(ii) 1-15 wt.-% of stearyloxypoly (ethyleneoxy)$_{20}$ethyl methacrylate; and (iii) 40-60 wt.-% of ethyl acrylate.

6. Liquid detergent concentrate composition according to claim 5, wherein the non-ionic surfactant is at least one alkoxylated fatty alcohol of the formula (IV) $R^5$—$(OC_2H_4)_x$—$(OC_3H_6)_y$—OH, wherein $R^5$ is a linear or branched $C_6$-$C_{24}$ alkyl or alkenyl group, x is 0 to 18 and y is 0 to 10 and the sum of x and y is at least 2 and one of x or y may be 0.

7. Liquid detergent concentrate composition according to claim 5, wherein the non-ionic surfactant is at least one ethoxylated and/or propoxylated fatty alcohol of the formula (IV) $R^5$—$(OC_2H_4)_x$—$(OC_3H_6)_y$—OH, wherein $R^5$ is a linear or branched $C_8$-$C_{18}$ alkyl or alkenyl group, x is 0 to 10 and y is 0 to 10 and the sum of x and y is at least 2 and one of x or y may be 0.

8. Liquid detergent concentrate composition according to claim 5, wherein the non-ionic surfactant is at least one ethoxylated and/or propoxylated fatty alcohol of the formula (IV) $R^5$—$(OC_2H_4)_x$—$(OC_3H_6)_y$—OH, wherein $R^5$ is a linear or branched $C_9$-$C_{16}$ alkyl or alkenyl group, x is 3 to 10 and y is 3 to 10 and the sum of x and y is at least 3.

9. Liquid detergent concentrate composition according to claim 5, wherein the non-ionic surfactant is at least one ethoxylated fatty alcohol of the formula (V) $R^6$—$(OC_2H_4)_m$—OH wherein $R^6$ is a linear or branched $C_9$-$C_{16}$ alkyl or alkenyl group and m is 3 to 10.

10. Liquid detergent concentrate composition according to claim 5, wherein the non-ionic surfactant is at least one ethoxylated fatty alcohol of the formula (V) $R^6$—$(OC_2H_4)_m$—OH, wherein $R^6$ is a linear or branched $C_{11}$-$C_{16}$ alkyl or alkenyl group and m is 5 to 10.

11. Liquid detergent concentrate composition according to claim 5, wherein the non-ionic surfactant is at least one ethoxylated guerbet alcohol of the formula (V) $R^6$—$(OC_2H_4)_m$—OH, wherein $R^6$ is a branched $C_9$-$C_{20}$ alkyl group and m is from 2 to 10.

12. Liquid detergent concentrate composition according to claim 1, wherein the detergent concentrate has a viscosity range of from 1 to 3000 mPas at 20° C. measured at 20 revolutions per minute on a Brookfield RVT viscosimeter with spindle #2.

13. Liquid detergent concentrate composition according to claim 12, wherein the detergent additionally comprises additives selected from the group consisting of builder, pH modifier, antimicrobial agents, abrasives, anti-redeposition agents, sequestrants, softener, conditioner, viscosity modifying agents, wetting modifying agents, enzymes, optical brighteners, defoamers and mixtures thereof.

14. A system comprising a first component and a second component, wherein the first component is the liquid detergent concentrate composition according to claim 13 and the second component is containing a bleaching composition.

15. The system according to claim 14, wherein the bleaching composition comprises a peracid selected from:

a) peracids corresponding to general formula (VI) $R^7$—$O_2C$—$(CH_2)_p$—$CO_3H$, wherein $R^7$ is hydrogen or an alkyl group containing 1 to 4 carbon atoms and p is an integer from 1 to 4, or salts thereof;

b) phthalimidopercarboxylic acids (VII) wherein the percarboxylic acid contains 1 to 18 carbon atoms, or salts thereof;

c) compounds corresponding to formula (VIII) $R^8$—$CO_3H$, wherein $R^8$ is an alkyl or alkenyl group containing 1 to 18 carbon atoms.

16. The system according to claim 14, wherein the bleaching composition comprises a peracid selected from:

a) peracids corresponding to general formula (VI) $R^7$—$O_2C$—$(CH_2)_p$—$CO_3H$, wherein $R^7$ is hydrogen or methyl group and p is an integer from 1 to 4, or salts thereof;

b) phthalimidopercarboxylic acids (VII) wherein the percarboxylic acid contains 1 to 8 carbon atoms, or salts thereof;

c) compounds corresponding to formula (VIII) $R^8$—$CO_3H$, wherein $R^8$ is an alkyl or alkenyl group containing 1 to 12 carbon atoms.

17. The system according to claim 16, wherein the peracid is selected from peracetic acid, perpropionic acid, peroctanoic acid, phthalimidoperhexanoic acid, phthalimidoperoctanoic acid, persuccinic acid, persuccinic acid monomethyl ester, perglutaric acid, perglutaric acid monomethyl ester, peradipic acid, peradipic acid monomethyl ester, persuccinic acid, and persuccinic acid monomethyl ester.

18. The system according to claim 17, wherein the bleaching composition comprises 1 to 30 wt.-% of peracid.

19. The system according claim 18, wherein the bleaching composition additionally contains 0.01 to 35 wt.-% of hydrogen peroxide.

20. The system according to claim 19, wherein the bleaching composition comprises at least a mixture of hydrogen peroxide, peracid and the corresponding acid.

21. The system according to claim 20, wherein the bleaching composition comprises at least hydrogen peroxide, peroxyacetic acid and acetic acid.

22. Method for washing textiles comprising providing the liquid detergent concentrate composition according to claim 13;

diluting the liquid detergent to a stable aqueous use solution to a concentration of 0.5 to 25 wt.-% based on the total use solution;

optionally, adding a bleaching composition to the liquid detergent concentrate composition or to the use solution, wherein said bleaching composition comprises at least hydrogen peroxide, peroxyacetic acid and acetic acid; and washing the textiles in an institutional or a household washing machine in the use solution.

* * * * *